US005269323A

United States Patent [19]

Krouskop

[11] Patent Number: 5,269,323

[45] Date of Patent: Dec. 14, 1993

[54] BODY SUPPORT

[76] Inventor: Thomas A. Krouskop, 11915 Meadowtrail, Stafford, Tex. 77477

[21] Appl. No.: 984,771

[22] Filed: Dec. 3, 1992

[51] Int. Cl.[5] ..... A61G 15/00; A47G 9/00

[52] U.S. Cl. ..... 128/845; 5/632

[58] Field of Search ..... 128/845, 870, 869; 602/5, 12, 13, 15, 17, 19, 32, 33, 34, 35, 36, 39, 40; 5/630–633

[56] References Cited

U.S. PATENT DOCUMENTS

| | | | |
|---|---|---|---|
| 1,008,500 | 11/1911 | Thornton | 602/19 |
| 1,549,601 | 8/1925 | Mulgrew | 5/632 |
| 3,620,211 | 11/1971 | Goodell | 602/19 |
| 3,811,140 | 5/1974 | Burpo | 5/630 |
| 3,938,205 | 2/1976 | Spann | 5/632 |
| 4,173,048 | 11/1979 | Varaney | 5/632 |
| 4,223,670 | 9/1980 | Cramer | 128/870 |
| 4,624,021 | 11/1986 | Hofstetter | 5/632 |
| 4,733,836 | 3/1988 | Barnes | 5/630 |

*Primary Examiner*—Michael A. Brown
*Attorney, Agent, or Firm*—Fulbright & Jaworski

[57] ABSTRACT

A body support for supporting a human body lying on a bed in a side position including a body support, first and second flexible arms extending outwardly from the support with a head engaging structure connected to one of the arms and a leg engaging structure connected to the other arms for maintaining the body support against the body. The support may include a flat side, and an incline side and be right triangular in cross section. Preferably, the head engaging structure and leg engaging structure are substantially the same for reversibility.

3 Claims, 1 Drawing Sheet

FIG.1
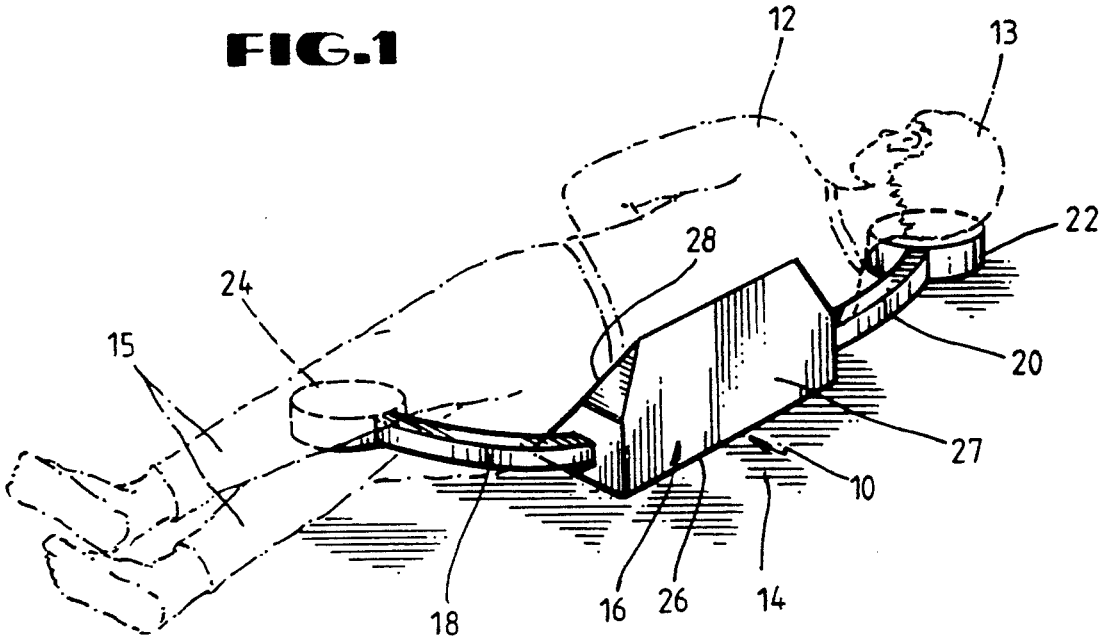
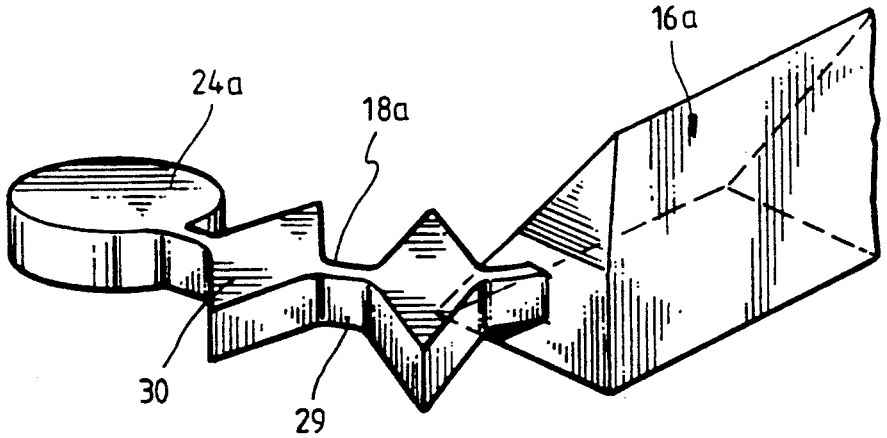
FIG.2

BODY SUPPORT

BACKGROUND OF THE INVENTION

The present invention relates to a body support for supporting a human body lying on a bed in a side position.

In order to prevent pressure sores and pressure induced soft tissue damage, and maintain proper body alignment for comfort, patients which lie in bed for a considerable period of time must be moved and propped up in various positions. For example, in order to vary the patient's position from a back or front position, it is common to place the patient in a side position by propping up the patient with pillows positioned against his or her back. However, the use of pillows is not generally satisfactory as they do not maintain their shape and are easily moved or pushed aside.

The present invention is directed to a body support which more firmly and securely supports a human lying on a bed in a side position, and is less likely to move or slide away from the body, and can be held in place by engagement of the patient's body, is reversible for supporting a patient on either side, and is symmetrical for placement without requiring a particular top or bottom orientation.

SUMMARY

The present invention is directed to a support for supporting a human body lying on a bed in a side position, the support includes a body support adapted to support a human body in a side position. The support includes first and second ends with first and second flexible arms extending outwardly from the first and second ends, respectively. A head engaging structure is connected to one of the arms and a leg engaging structure is connected to the other of the arms whereby the head and legs of the body may engage the head retaining structure and the leg retaining structure for maintaining the body support against the body.

A still further object of the present invention is wherein the support includes a flat side, and preferably includes an incline side and is preferably triangular in cross section.

Still a further object of the present invention is wherein the head engaging structure and the leg engaging structure are substantially the same allowing positioning of the body support against the body without requiring a particular top or bottom orientation.

Still a further object of the present invention is wherein the cross-sectional area of the arms is less than than the cross-sectional area of the head engaging structure and the leg engaging structure.

Other and further objects, features and advantages will be apparent from the following description of the presently preferred embodiments of the invention, given for the purpose of disclosure and taken in conjunction with the accompanying drawing.

BRIEF DESCRIPTION OF THE DRAWING

FIG. 1 is a perspective, elevational view of the present invention in position supporting a patient in a side position, and FIG. 2 is a fragmentary, perspective elevational view of another embodiment of the present invention.

BRIEF DESCRIPTION OF THE PREFERRED EMBODIMENT

Referring now to the drawing, and particularly to FIG. 1, the reference numeral 10 generally indicates the body support system of the present invention for engagement with a human body 12, lying on a bed 14, in a side position.

The body support system 10 includes a body support 16, first and second flexible arms 18 and 20, a head engaging structure 22 connected to one of the arms and a leg engaging structure 24 connected to the other arm.

The body support 16 may be of any suitable shape, but preferably includes a flat side 26 for providing a greater frictional contact area with the bed for preventing slipping. Also, preferably, the body support 16 includes an incline side 28 which when placed against the body 12 acts as a wedge or chock and the weight of the body 12 against the incline side 28 tends to increase the frictional pressure on the flat side 26 for acting to maintain the body support 16 in position. Also, it is preferred that the support includes a third side 27 which is flat and is perpendicular to side 26. Thus, the support 16 can be rotated 90° and support the patient 12 on his opposite side. Thus, the preferred shape of the body support 16 is triangular in cross section and preferably right triangular in cross section. While the body support 16 may be of any other shape, such as square, the right triangular shape provides a more stable positioning structure and is useful for supporting the patient on either side. Also, while the body support 16 is shown positioned against the back of the patient 12, it may also be positioned against the front of the patient 12, if desired, to vary the position of the patient 12 on the bed 14.

However, in order to more fully secure or hold the position of the body support 16 against the patient's body 12 other body engaging structure is provided. Thus, a flexible arm 20 is provided connected to the body support 16 and attached to the head engaging structure 22 which in effect forms a pillow for the head 13 of the patient 12. In addition, a second flexible arm 18 is connected to the body support 16 and extends outwardly from the end of the body support 16 and is connected to a leg engaging structure 24. Thus, with the head engaging structure 22 engaged by the head 13 and with the arm 18 extending between the legs 15 of the patient 12 thereby engaging and holding the leg engaging structure 24, the body support 16 is more firmly secured against the body of the patient 12.

Preferably, the system 12 is symmetrical with both the head engaging structure 22 and the leg engaging structure 24 being the same. This type of symmetrical system 10 allows either the structure 22 or 24 to be used as a head engaging structure or leg engaging structure. Furthermore, the system 10, shown in FIG. 1 as supporting a patient 12 on his right side, can be rotated 90° for supporting the patient on his or her left side.

While the body support 16, the arms 18 and 20, and the head supporting structure 22 and leg engaging structure 24 may be of any suitable material, one satisfactory material is a conventional high resilient open cell foam, such as polyurethane foam, which, for sanitary reasons, is enclosed in a covering, such as vinyl, removable cloth or other suitable material.

The cross-sectional area of the arms is less than the cross-sectional area of the head engaging structure and the leg engaging structure.

Other and further embodiments may be provided, such as the one shown in FIG. 2, wherein parts similar to those shown in FIG. 1 are similarly numbered with the suffix "a". In this case, the arms, such as arm 18*a*, consists of a thin web area 29 alternating with diamond shaped areas 30 which allow greater flexibility of the arms 18*a* but also allow longitudinal rotation of the arm 18*a* as required for positioning in engagement by the body 12.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art, and which are encompassed with in the spirit of the invention, and the scope of the appended claims.

What is claimed is:

1. A body support system for supporting the back of a human body in a side position comprising, a body support adapted to support the back of a human body in a side position, the cross section of the support is triangular and includes a flat side and an inclined side, said flat side is adapted to be positioned on a body support surface and the inclined side is adapted to be positioned adjacent the back of the human body, said support having a longitudinal axis and having first and second ends, and first and second arms extending outwardly from the first and second ends, respectively, and said arms being flexible so as to be positioned away from the longitudinal axis, and a head engaging structure connected to one of the arms forming a pillow for the head of the body, and a leg engaging structure connected to the other of the arms for extending between the legs of the body whereby the head and legs of the body may hold the head engaging structure the leg engaging structure, respectively, for maintaining the body support against the back of the body.

2. The support system of claim 1 wherein said head engaging structure and said leg engaging structure are substantially the same.

3. The support system of claim 1 wherein the cross-sectional area of the arms is less than the cross-sectional area of the head engaging structure and the leg engaging structure.

* * * * *